US010059563B2

(12) United States Patent
Agirman

(10) Patent No.: US 10,059,563 B2
(45) Date of Patent: Aug. 28, 2018

(54) ELEVATOR CAR SPEED CONTROL IN A BATTERY POWERED ELEVATOR SYSTEM

(71) Applicant: OTIS ELEVATOR COMPANY, Farmington, CT (US)

(72) Inventor: Ismail Agirman, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 433 days.

(21) Appl. No.: 14/767,381

(22) PCT Filed: Feb. 14, 2013

(86) PCT No.: PCT/US2013/026047

§ 371 (c)(1),
(2) Date: Aug. 12, 2015

(87) PCT Pub. No.: WO2014/126563

PCT Pub. Date: Aug. 21, 2014

(65) Prior Publication Data

US 2015/0375959 A1 Dec. 31, 2015

(51) Int. Cl.

*B66B 1/28* (2006.01)
*B66B 1/30* (2006.01)
*B66B 5/14* (2006.01)

(52) U.S. Cl.

CPC ..... *B66B 1/302* (2013.01); *B66B 5/14* (2013.01); *B66B 1/308* (2013.01)

(58) Field of Classification Search

CPC ..... B66B 1/302; B66B 5/14; B66B 1/308
(Continued)

(56) References Cited

U.S. PATENT DOCUMENTS 4,456,097 A * 6/1984 Salihi ..... H02J 7/008 187/289
4,554,999 A 11/1985 Kamaike
(Continued)

FOREIGN PATENT DOCUMENTS

CN 1902116 A 1/2007
EP 2500309 A1 9/2012
(Continued)

OTHER PUBLICATIONS

International Search Report for application PCT/US2013/026047, dated Oct. 24, 2013, 6 pages.
(Continued)

*Primary Examiner* — Anthony Salata
(74) *Attorney, Agent, or Firm* — Cantor Colburn LLP

(57) ABSTRACT

An elevator system includes a battery; a machine having a motor for imparting motion to an elevator car; an inverter for converting DC power from the battery to AC power for the machine in motoring mode and converting AC power from the machine to DC power for the battery in regenerative mode; and a controller to control the inverter, the controller implementing at least one of: detecting an overload at the battery in motoring mode and reducing car speed in response to the overload; detecting an overcharge at the battery in regenerative mode and reducing car speed in response to the overcharge; detecting motor direct current in a motor field weakening mode and reducing car speed in response to the motor direct current; and detecting car load and adjusting car speed in response to car load.

17 Claims, 7 Drawing Sheets

(58) Field of Classification Search
USPC ..... 187/288, 289, 290, 396, 397, 391, 393, 187/277, 281, 293, 296, 297; 318/375, 318/376, 798–815
See application file for complete search history.

(56) References Cited

U.S. PATENT DOCUMENTS

| | | | | |
|---|---|---|---|---|
| 4,987,977 | A | 1/1991 | Nomura | |
| 5,780,786 | A * | 7/1998 | Miyanishi | B66B 1/285 187/281 |
| 5,893,432 | A * | 4/1999 | Nguyen | B66B 5/02 187/290 |
| 5,896,948 | A * | 4/1999 | Suur-Askola | B66B 1/30 187/290 |
| 6,315,081 | B1 * | 11/2001 | Yeo | B66B 5/02 187/290 |
| 6,435,312 | B2 | 8/2002 | Tajima et al. | |
| 6,439,347 | B2 * | 8/2002 | Suga | B66B 1/30 187/290 |
| 6,457,565 | B2 * | 10/2002 | Tominaga | B66B 1/30 187/290 |
| 6,460,658 | B2 * | 10/2002 | Suga | B66B 1/30 187/290 |
| 6,732,838 | B1 | 5/2004 | Okada et al. | |
| 6,827,182 | B2 * | 12/2004 | Araki | B66B 5/027 187/290 |
| 8,127,894 | B2 | 3/2012 | Agirman et al. | |
| 8,146,714 | B2 * | 4/2012 | Blasko | B66B 1/30 187/290 |
| 8,172,042 | B2 * | 5/2012 | Wesson | B66B 1/308 187/290 |
| 8,887,872 | B2 * | 11/2014 | Chen | G01R 31/3651 187/290 |
| 2002/0189906 | A1 | 12/2002 | Tominaga et al. | |
| 2005/0006182 | A1 * | 1/2005 | Hall | B66B 5/02 187/290 |
| 2016/0194179 | A1 * | 7/2016 | Agirman | B66B 1/32 187/289 |

FOREIGN PATENT DOCUMENTS

| | | | |
|---|---|---|---|
| JP | 2012062149 | A | 3/2012 |
| KR | 100829319 | B1 | 5/2008 |

OTHER PUBLICATIONS

Written Opinion for application PCT/US2013/026047, dated Oct. 24, 2013, 6 pages.
European Search Report for application EP 13875300, dated Sep. 14, 2016, 9 pages.
Chinese Second Office Action and Search Report, CN 201380073062.9 , dated Jan. 17, 2017, 5pgs.

* cited by examiner

ELEVATOR CAR SPEED CONTROL IN A BATTERY POWERED ELEVATOR SYSTEM

FIELD OF INVENTION

The subject matter disclosed herein relates generally to the field of elevator systems, and more particularly, to elevator car speed control in a battery powered elevator system.

BACKGROUND

Battery powered elevator systems employ a battery as a power source to an elevator machine that imparts motion to the elevator car. A drive unit containing an inverter is typically connected between the battery and the machine. In motoring mode, the inverter converts DC power from the battery to AC drive signals for the machine. In regenerative mode, the inverter converts AC power from the machine to DC power for charging the battery.

In a battery powered elevator system, the battery may experience overloading when in motoring mode or overcharging in regenerative mode. Overloading negatively affects state of charge/usability of the battery as a voltage/power source. Overcharging negatively affects the health of the battery. Overcharging is normally controlled using a dynamic braking resistor, and overloading is normally controlled with profile modifications.

BRIEF SUMMARY

According to an exemplary embodiment, an elevator system includes a battery; a machine having a motor for imparting motion to an elevator car; an inverter for converting DC power from the battery to AC power for the machine in motoring mode and converting AC power from the machine to DC power for the battery in regenerative mode; and a controller to control the inverter, the controller implementing at least one of: detecting an overload at the battery in motoring mode and reducing car speed in response to the overload; detecting an overcharge at the battery in regenerative mode and reducing car speed in response to the overcharge; detecting motor direct current in a motor field weakening mode and reducing car speed in response to the motor direct current; and detecting car load and adjusting car speed in response to car load.

Other aspects, features, and techniques of embodiments of the invention will become more apparent from the following description taken in conjunction with the drawings.

BRIEF DESCRIPTION OF THE DRAWINGS

Referring now to the drawings wherein like elements are numbered alike in the FIGURES.

DETAILED DESCRIPTION

Figure 1:
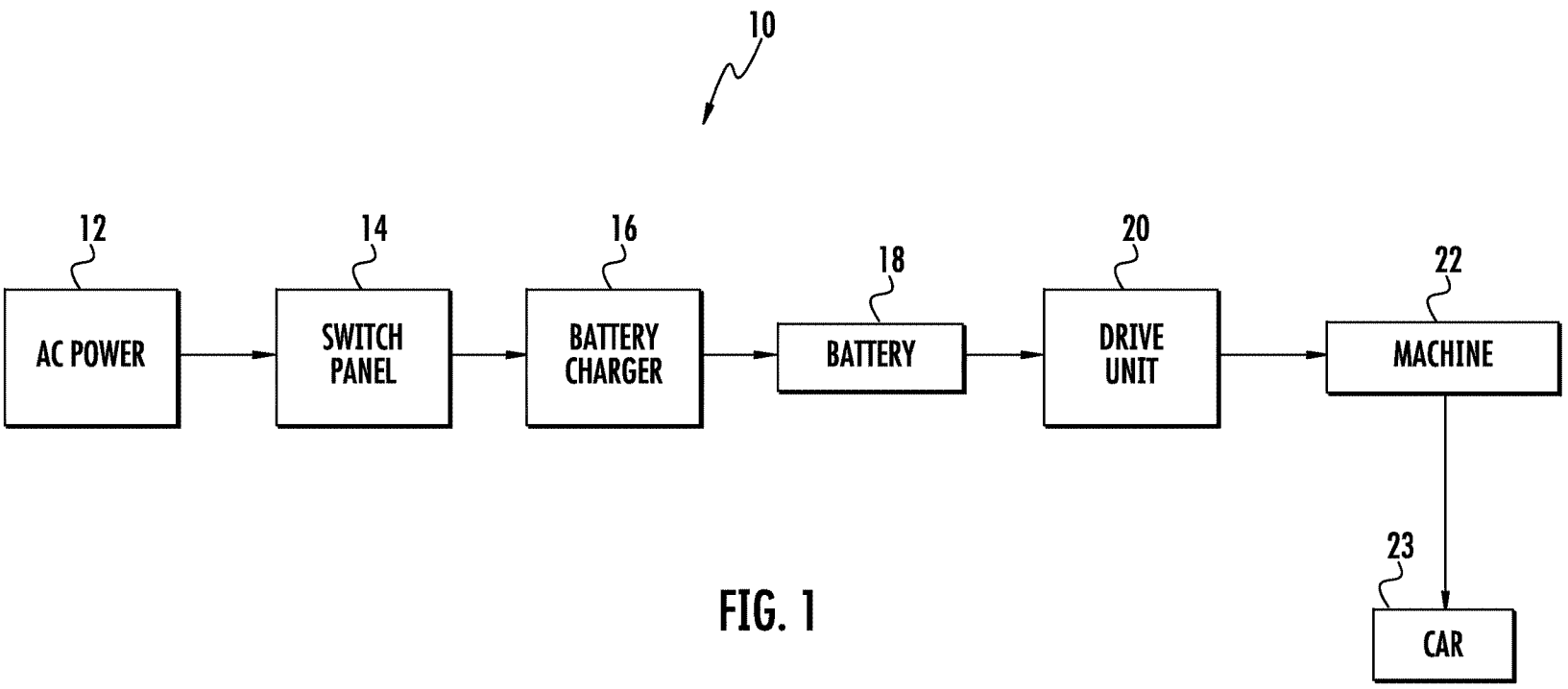
FIG. 1 is a block diagram of components of elevator system in an exemplary embodiment.

FIG. 1 is a block diagram of components of an elevator system 10 in an exemplary embodiment. Elevator system 10 includes a source of AC power 12, such as an electrical main line (e.g., 230 volt, single phase). The AC power 12 is provided to a switch panel 14, which may include circuit breakers, meters, etc. From the switch panel 14, AC power is provided to a battery charger 16, which converts the AC power to DC power to charge battery 18. Battery 18 may be a lead-acid battery or other type of battery. Battery 18 powers drive unit 20, which inverts DC power from battery 18 to AC drive signals, which drive machine 22 to impart motion to elevator car 23. The AC drive signals may be multiphase (e.g., three-phase) drive signals for a three-phase motor in machine 22. It is noted that battery 18 is the sole power source to the drive unit 20, and the AC power 12 is not directly coupled to the drive unit 20.

Figure 2:
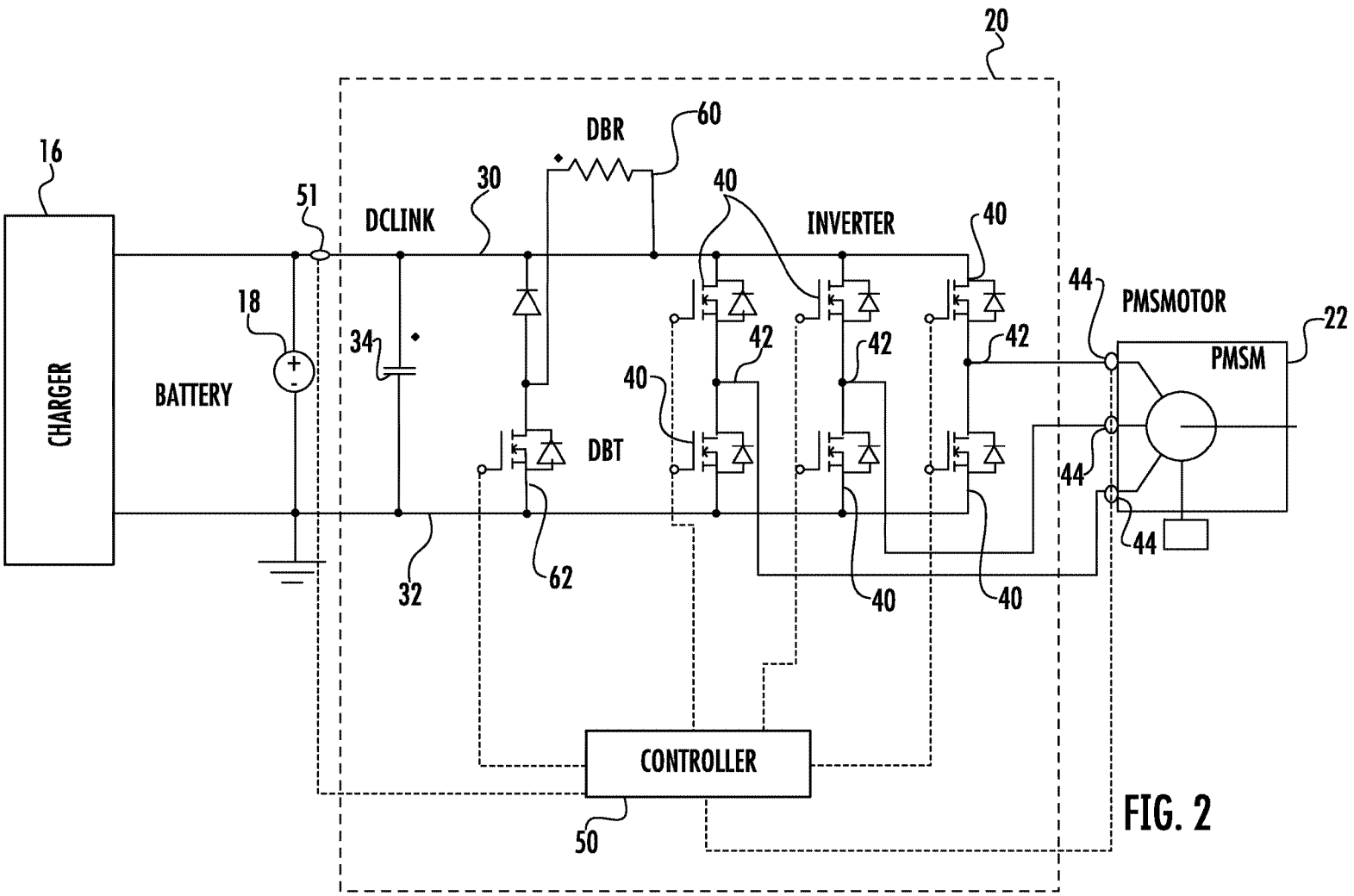
FIG. 2 depicts components of elevator system in an exemplary embodiment.

FIG. 2 depicts components of elevator system 10 in an exemplary embodiment. Drive unit 20 includes a first DC link 30 coupled to battery 18 (e.g., a positive DC voltage) and a second DC link 32 coupled to battery 18 (e.g., a negative DC voltage or ground). One or more DC link capacitors 34 are connected between the first DC link 30 and second DC link 32. An inverter section uses switches 40 to generate drive signals for the motor of machine 22. Switches 40 may be MOSFET transistors, but it is understood other types of switches may be used. Switches 40 are arranged in phase legs, each phase leg connected between the first DC link 30 and the second DC link 32. An AC terminal 42 is provided at a junction (e.g., source-drain junction) of the switches 40 in each phase leg. AC terminals 42 are coupled to motor windings of machine 22. In an exemplary embodiment, machine 22 includes a three-phase, permanent magnet synchronous motor. FIG. 2 depicts a three-phase inverter and three-phase motor, but embodiments are not limited to a particular number of phases.

The inverter converts DC power from battery 18 to AC power for driving machine 22 in motoring mode. The inverter also converts AC power from machine 22 to DC power for charging battery 18 when operating in regenerative mode. Regenerative mode may occur when an empty elevator car is traveling upwards or when a loaded elevator car is traveling downwards. Regenerative mode may include a regenerative brake of machine 22 providing AC power. The AC power received at AC terminals 42 is converted to DC power to charge battery 18.

During motoring mode, controller 50 provides control signals to turn switches 40 on and off to generate an AC drive signal at each AC terminal 42. The AC drive signal may be a variable frequency signal. During regenerative mode, controller 50 provides control signals to turn switches 40 on and off to convert AC power from machine 22 to DC power for charging battery 18. Current sensors 44 are provided at each AC terminal 42 to allow controller 50 to detect current at each AC terminal 42, in both motoring mode and regenerative mode. A voltage sensor 51 is provided at battery 18 to detect battery voltage and provide a sensed voltage to controller 50. Controller 50 may be implemented using a general-purpose microprocessor executing a computer program stored on a storage medium to perform the operations described herein. Alternatively, controller 50 may be implemented in hardware (e.g., ASIC, FPGA) or in a combination of hardware/software. Controller 50 may also be part of an elevator control system.

Drive unit 20 also includes a dynamic braking resistor 60 and a dynamic braking switch 62. Dynamic braking switch 62 may be a MOSFET transistor, but it is understood other types of switches may be used. In regenerative mode, if the current produced at machine 22 is excessive, the dynamic braking switch 62 is turned on (e.g., pulsed on and off with a duty cycle) and current flows through dynamic braking resistor 60. Excess energy is dissipated through the dynamic braking resistor 60. It is understood that multiple dynamic braking resistors 60 and a dynamic braking switches 62 may be employed in drive unit 20.

In exemplary embodiments, controller 50 controls the speed of elevator car 23 in response to operating parameters of the elevator system including battery voltage, motor direct current, car load, etc. An exemplary embodiment protects battery 18 from overloading (i.e., overdrawing current) when the machine 22 is operating in motoring mode. If the machine 22 overloads battery 18, the battery voltage will drop. Controller 50 monitors the sensed battery voltage from voltage sensor 51 and adjusts the car speed in response to the sensed battery voltage. In motoring mode, controller 50 may compare the sensed battery voltage to a threshold and if the sensed battery voltage is less than the threshold (optionally, for a period of time), controller 50 reduces the car speed by some predetermined amount (e.g., a set m/sec or a percentage of current speed). Further, multiple thresholds may be used to provide finer control of the speed reduction. In other embodiments, the car speed is derived based on a function relating battery voltage to car speed, so that continuous speed adjustment is performed by controller 50 in response to the sensed battery voltage. The threshold(s) used or the function relating battery voltage to car speed may also be dependent upon the type of battery (e.g., lead-acid, Li-ion, etc.).

Figure 3:
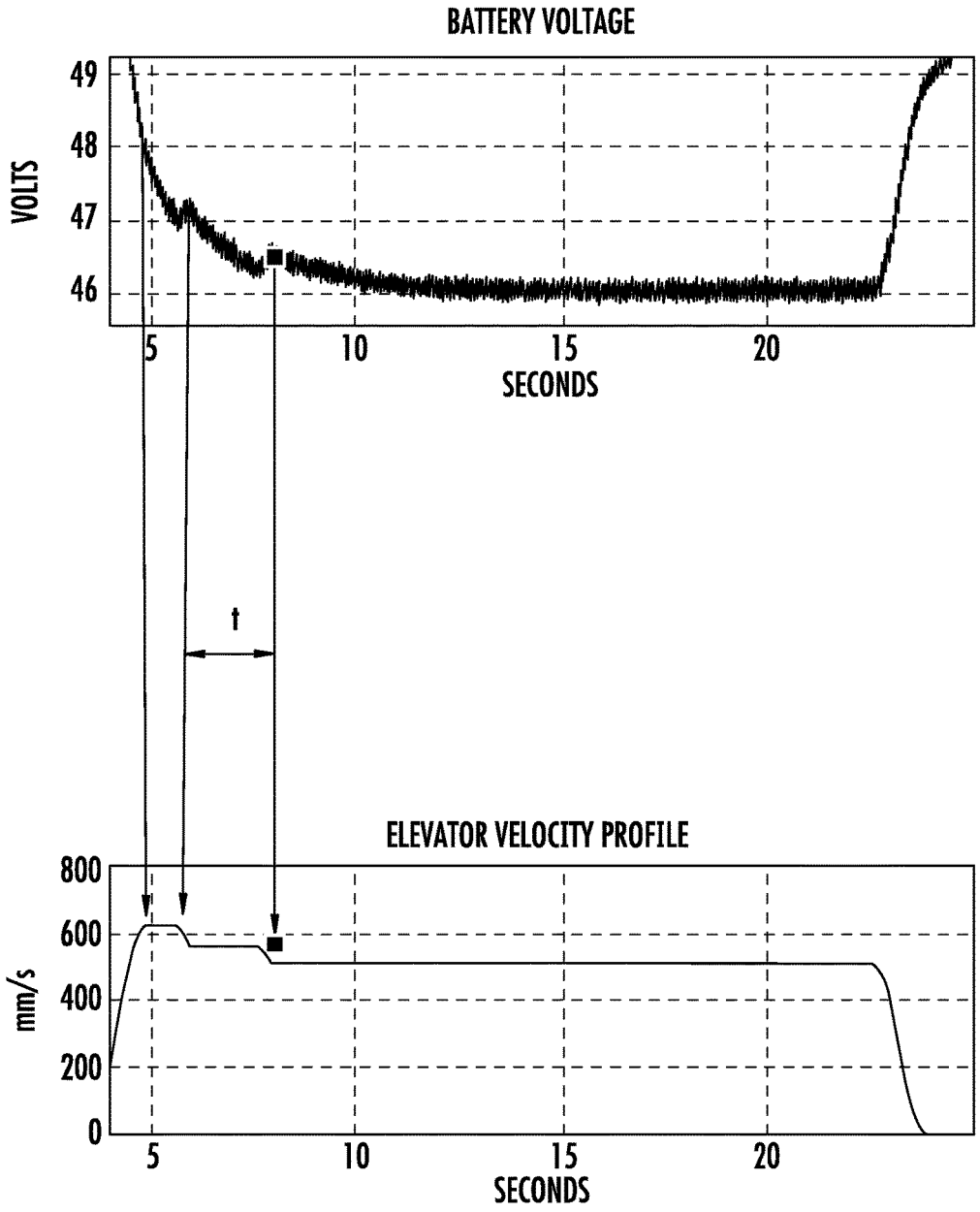
FIG. 3 depicts plots of battery voltage and elevator car speed in an exemplary embodiment for controlling battery overloading.

FIG. 3 depicts plots of battery voltage and elevator car speed in an exemplary embodiment for controlling battery overloading. When the sensed battery voltage drops below 48V (as an example threshold), controller 50 adjusts the car speed from a first speed (e.g., 630 mm/s) to a lower, second speed (e.g., 580 mm/s). If the sensed battery voltage remains below the threshold for a certain period time (e.g., t), controller 50 may again reduce the car speed. As noted above, multiple voltage thresholds may be used or the car speed may be related to the sensed battery voltage through a function to provide continuous speed adjustment. In alternate embodiments, the rate of change of the sensed battery voltage may be used to control car speed, such that if the sensed battery voltage has stabilized (e.g., rate of change of sensed battery voltage less than a threshold), then no further speed adjustment is made.

An exemplary embodiment protects battery 18 from overcharging when the machine 22 is operating in regenerative mode. In existing systems, the dynamic braking resistor 60 is used to dissipate excess current in regenerative mode. The dynamic braking resistor 60 may be pulsed on-off with a duty cycle to regulate the current dissipated. When a large regenerative current is present, even at a 100% duty cycle, the dynamic braking resistor 60 may not be able to dissipate all of the energy associated with the excess current. This could result in battery 18 being overcharged and damaged.

To address this issue, controller 50 monitors the sensed battery voltage from voltage sensor 51 and adjusts the car speed in response to the sensed battery voltage. In regenerative mode, controller 50 may compare the sensed battery voltage to a threshold and if the battery sensed battery voltage is greater than the threshold (optionally, for a period of time), controller 50 may increasingly turn on the dynamic braking switch 62 to dissipate regenerative current through dynamic braking resistor 60. If the dynamic braking resistor 60 is at full capacity (e.g., dynamic braking switch 62 is on with 100% duty cycle) and the sensed battery voltage from voltage sensor 51 is still above the threshold (which threshold may be determined to ensure battery health), controller 50 reduces the car speed by some predetermined amount (e.g., a set m/sec or a percentage of current speed). Further, multiple thresholds may be used to provide finer control of the speed reduction. In other embodiments, the car speed is derived based on a function relating battery voltage to car speed, so that continuous speed adjustment is performed by controller 50 in response to the sensed battery voltage. The threshold(s) used or the function relating battery voltage to car speed may also be dependent upon the type of battery (e.g., lead-acid, Li-ion).

Figure 4:
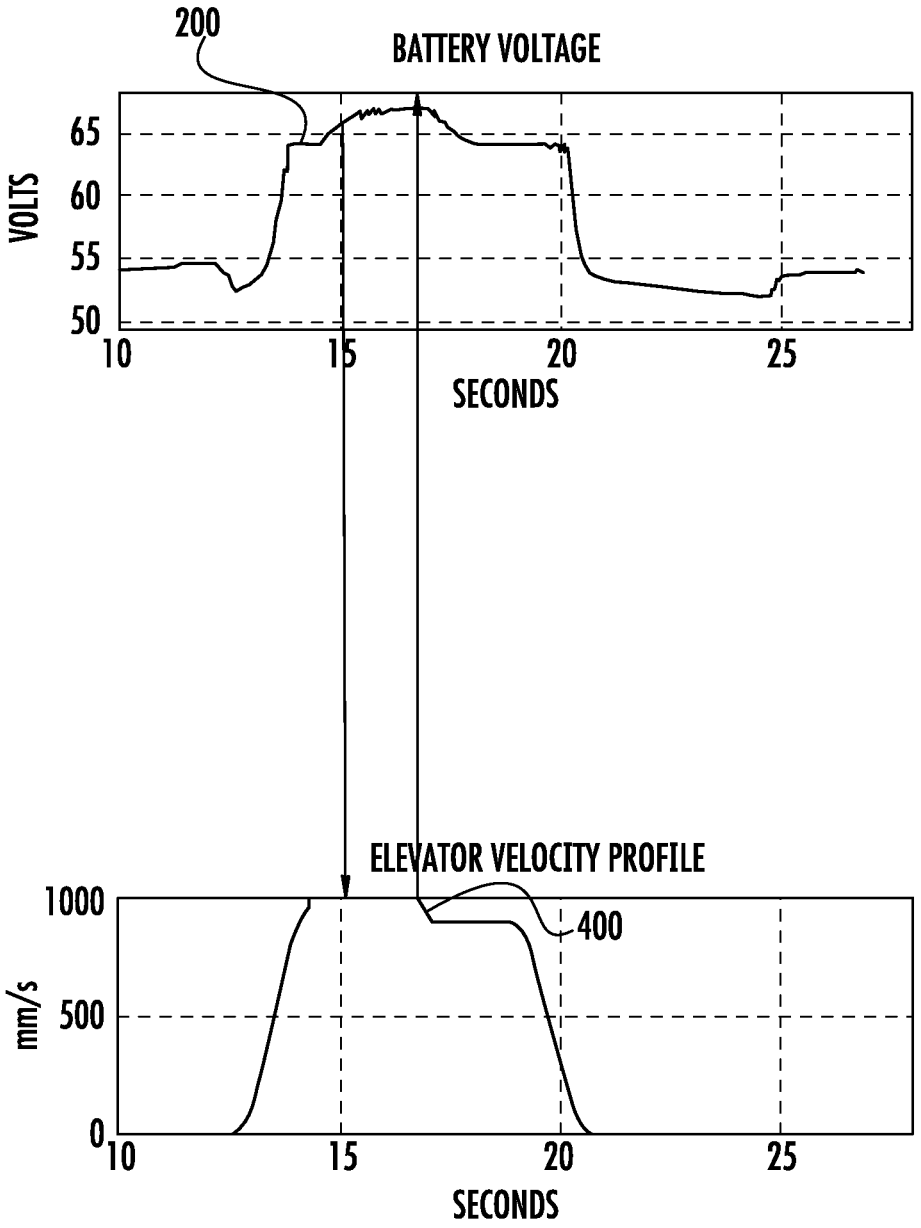
FIG. 4 depicts plots of battery voltage and elevator car speed in an exemplary embodiment for controlling battery overcharging.

FIG. 4 depicts plots of battery voltage and elevator car speed in an exemplary embodiment for controlling battery overcharging. When the sensed battery voltage exceeds threshold (e.g., 64 volts), controller 50 activates the dynamic braking switch 62, which stabilizes the increasing battery voltage as shown at section 200. Eventually, the dynamic braking resistor can dissipate no further energy and the sensed battery voltage increases. At this point, controller 50 reduces the speed of the car 23 to reduce the regenerative current from machine 22. If the sensed battery voltage exceeds the threshold for a certain period time, controller 50 may again reduce the car speed as shown at 400. As noted above, multiple voltage thresholds may be used or the car speed may be related to the sensed battery voltage through a function to provide continuous speed adjustment. In alternate embodiments, the rate of change of the sensed battery voltage may be used to control car speed, such that if the sensed battery voltage has stabilized, then no further speed adjustment is made.

Another exemplary embodiment protects battery 18 from a voltage deficiency when the controller 50 is operating the motor of machine 22 in field weakening mode. Field weakening mode is a known operational mode for motors, and involves increased winding current (this current is called d-axis current, field weakening current, or voltage regulating current in motor control terminology) to achieve higher speeds at the torques demanded by the motor due to elevator motion. Field weakening is an acceptable mode of operation, as long as the current to the motor is not significant and the battery is not overloaded.

To protect the battery from a voltage deficiency (due to increased losses in the motor and/or increased power from motor) and also to protect the motor from excessive current, in field weakening mode, controller 50 monitors motor direct current (d-axis current) through processing of current sensors 44 signals (known as 3/2-DQ transformations to the control field). In field weakening mode, controller 50 may compare the sensed motor direct current to a threshold and if the sensed motor direct current is greater than the threshold (optionally, for a period of time), controller 50 reduces the car speed by some predetermined amount (e.g., a set m/sec or a percentage of current speed). Further, multiple thresholds may be used to provide finer control of the speed reduction. In other embodiments, the car speed is derived based on a function of the sensed motor direct current, so that continuous speed adjustment is performed by controller 50 in response to the sensed motor direct current. The threshold(s) used or the function relating sensed motor direct current to car speed may also be dependent upon the type of battery (e.g., lead-acid, Li-ion, etc.).

Figure 5:
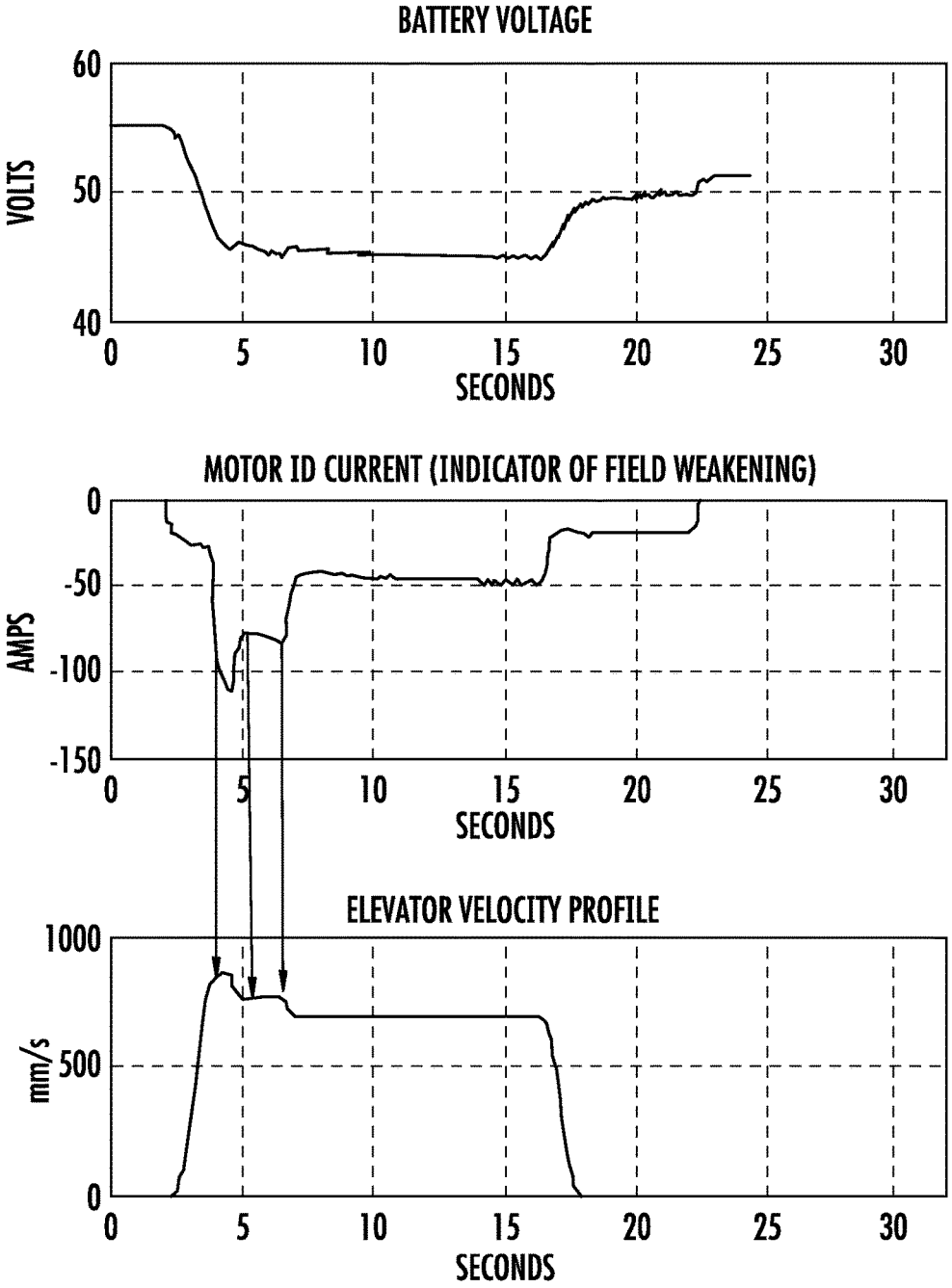
FIG. 5 depicts plots of battery voltage, machine direct current and elevator car speed in an exemplary embodiment for controlling a battery voltage deficiency in field weakening mode.

FIG. 5 depicts plots of battery voltage, motor direct current and elevator car speed in an exemplary embodiment for controlling a battery voltage deficiency. When the sensed motor direct current exceeds a threshold (e.g., 100 amps), controller 50 reduces the speed of the car 23 to reduce the current draw of the motor. If the sensed motor direct current exceeds the threshold for a certain period time, controller 50 may again reduce the car speed. As noted above, multiple thresholds may be used or the car speed may be related to the sensed motor direct current through a function to provide continuous speed adjustment. In alternate embodiments, the rate of change of the sensed motor direct current may be used to control car speed, such that if the sensed motor direct current has stabilized, then no further speed adjustment is made. Controlling car speed in response to sensed motor direct current in field weakening mode may also be used to allow the car to travel at high speeds for limited time periods until the battery voltage drops, at which point the car speed is reduced to accommodate the battery deficiency.

Figure 6:
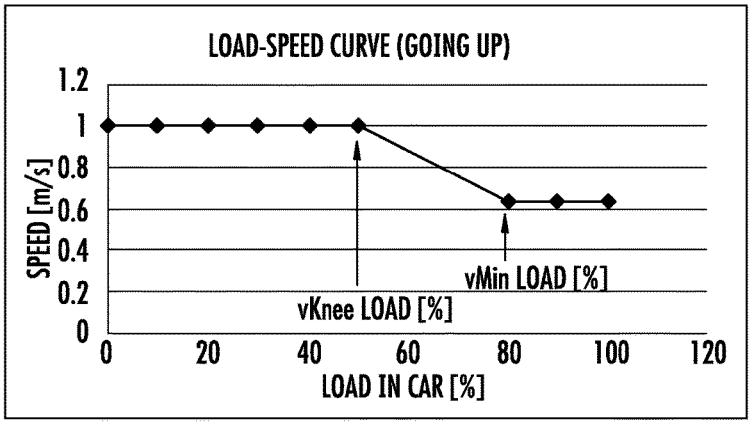
FIG. 6 is a plot of car load versus car speed in an exemplary embodiment for controlling car speed in response to car load.

Another exemplary embodiment controls car speed in response to car travel direction and car load. When car 23 is traveling upwards and the load is low, the car speed may be set at an upper speed value (e.g., 1 m/s). This is due to the fact that machine 22 does not require a large amount of power to raise car 23 under low loads, which imposes a lower draw of power from battery 18. As the car load increases, the controller 50 reduces the speed of car 23 to a lower speed value (e.g., 630 mm/s) to reduce power needed at machine 22 and thus drain of battery 18. FIG. 6 is a plot of car load versus car speed for an upward traveling car in an exemplary embodiment for controlling car speed in response to car load. As shown in FIG. 6, when the load is below a load threshold, the car speed is set at an upper speed value (e.g., 1 m/s). Once the car load crosses a load threshold (e.g., 50% of maximum load) the speed is reduced linearly until a lower speed value (e.g., 630 mm/s) is reached at a load limit (e.g., 80% of maximum load). It is understood that car load may be represented in formats other than a percentage of maximum load.

The upper speed value, lower speed value, load threshold and load limit of FIG. 6 are exemplary values. It is understood that other values may be used for these parameters. Further, multiple load thresholds may be used to provide finer control of the car speed. In other embodiments, the car speed is derived based on a function of the car load, so that continuous speed adjustment is performed by controller 50 in response to the car load.

Figure 7:
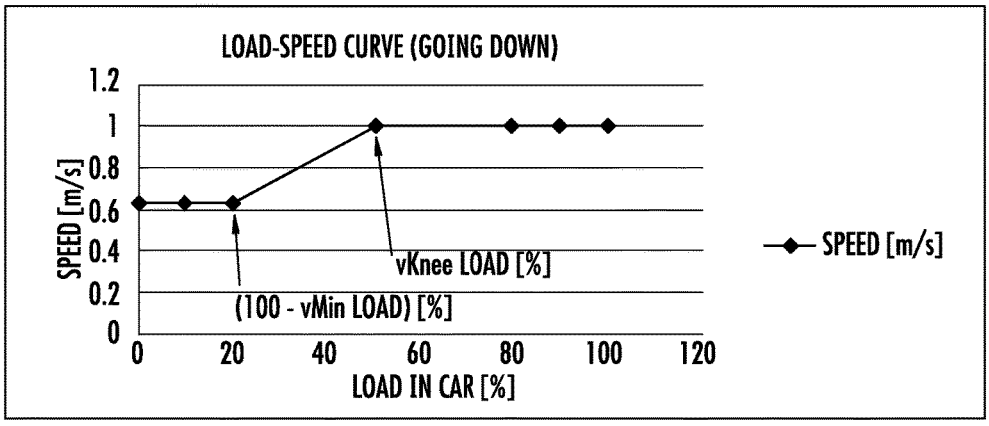
FIG. 7 is a plot of car load versus car speed in an exemplary embodiment for controlling car speed in response to car load.

The opposite direction of travel is shown in FIG. 7. When car 23 is traveling down and the load is low, the car speed may be set at a low speed value (e.g., 630 mm/s). This is due to the fact that machine 22 requires a larger amount of power to lower car 23 under low loads, which imposes a larger draw of power from battery 18. As the car load increases, controller increases the speed of car 23 to an upper speed value (e.g., 1 m/s), as machine 23 requires less power from battery 18 to lower a more loaded car. FIG. 7 is a plot of car load versus car speed in an exemplary embodiment for controlling car speed in response to car load. As shown in FIG. 7, when the load is below a load threshold, the car speed is set at a lower speed value (e.g., 630 mm/s). Once the car load crosses a load threshold (e.g., 20% of maximum load) the speed is increased linearly until an upper speed value (e.g., 1 m/s) is reached at a load limit (e.g., 50% of maximum load). It is understood that car load may be represented in formats other than a percentage of maximum load.

The upper speed value, lower speed value, load threshold and load limit of FIG. 7 are exemplary values. It is understood that other values may be used for these parameters. Further, multiple load thresholds may be used to provide finer control of the car speed. In other embodiments, the car speed is derived based on a function of the car load, so that continuous speed adjustment is performed by controller 50 in response to the car load.

In the embodiments of FIG. 6 and FIG. 7, the car load may be obtained in a variety of manners. In one embodiment, car 23 is equipped with a load measurement system that measures load of car 23. In another embodiment, car load is derived from a velocity control output produced by controller 50. As known in the art, a velocity measurement of car 23, prior to car acceleration, may be used as an indicator of car load by comparing a speed command value to measured speed. In other words, the output of a speed controller (which may be speed proportional-integral (PI) regulator or PI regulator followed by a P regulator), which is the torque command to the motor, can be latched after the machine brake is lifted, and preferably after a certain amount of time has passed to allow for signal filtering. Preferably, latching the torque command takes place immediately prior to actual elevator motion. This latched torque command can be converted to load in a car estimate via a linear relationship.

It is noted that the elevator speed control in field weakening mode (FIG. 5) may be used in conjunction with speed control based on car load (FIG. 6 and FIG. 7). For example, if the elevator speed control routine commands an increase in car speed, this may result in motor of machine 22 entering field weakening mode. In such a situation, controller 50 would reduce the car speed in response to the motor direct current to prevent battery overload as described with reference to FIG. 5. In other embodiments, some level of field weakening current injection may be performed to compensate for variations in machine voltage due to temperature or material variation. Field weakening may be used in conjunction with load based speed scheduling to ensure that a commanded speed is achieved. However, if the motor direct current in field weakening mode is above the threshold, then the speed reduction method of FIG. 5 may be employed as described above. Thus, the elevator speed control in field weakening mode may augment the speed control based on car load.

Figure 8:
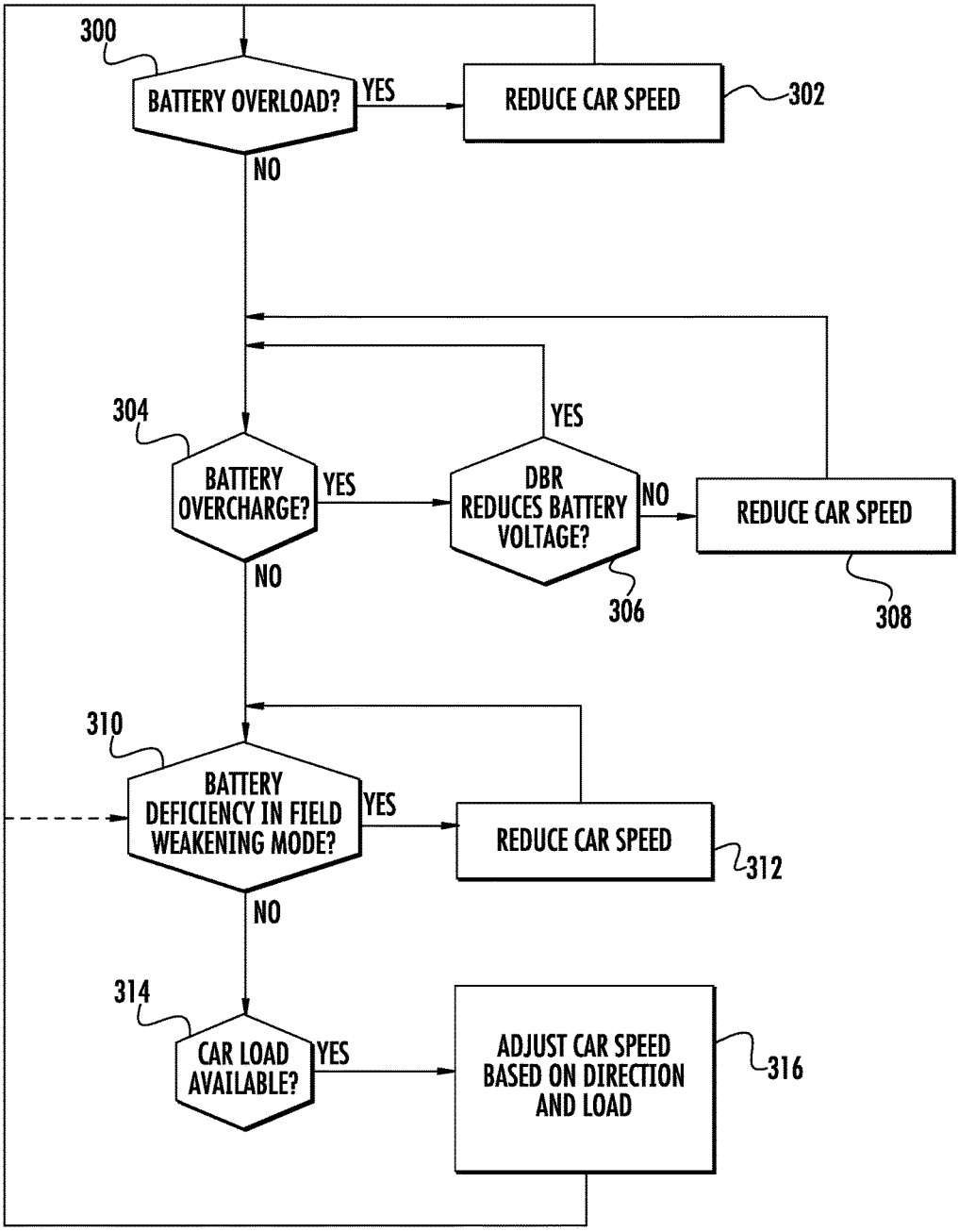
FIG. 8 is flowchart of a process for controlling car speed in an exemplary embodiment.

FIG. 8 is a flowchart of a process performed by controller 50 in an exemplary embodiment. It is understood that the order of steps in FIG. 8 is exemplary, and more than one control block may implemented simultaneously, as part of a continuous control process. At 300, controller 50 determines if battery 18 is overloaded in motoring mode by monitoring battery voltage sensed at voltage sensor 51. If the sensed battery voltage is too low, flow proceeds to 302, where controller 50 reduces the car speed by an amount (e.g., a set m/sec or a percentage of current speed). Flow proceeds back to 300, where the controller 50 continues to monitor battery voltage until the battery voltage is at a suitable level. Further speed reductions at 302 may be employed in a stepwise manner until the battery voltage is below the threshold.

If battery 18 is not overloaded at 300, flow proceeds to 304 where controller 50 determines if battery 18 is overcharged in regenerative mode by monitoring battery voltage sensed at voltage sensor 51. If the sensed battery voltage is too high at 304, flow proceeds to 306, where controller 50 attempts to reduce battery voltage through the dynamic braking resistor 60. If the dynamic braking resistor 60 reduces the battery voltage to an acceptable level, flow returns to 304. If not, flow proceeds to 308 where controller 50 reduces the car speed by an amount (e.g., a set m/sec or a percentage of current speed). Flow proceeds back to 304, where the controller 50 continues to monitor battery voltage until the battery voltage is at a suitable level. Further speed reductions at 308 may be employed in a stepwise manner until the battery voltage is below the threshold.

If battery 18 is not overcharged at 304, flow proceeds to 310 where controller 50 determines if motor direct current in field weakening mode is too high. If so, flow proceeds to 312 where controller 50 reduces the car speed by an amount (e.g., a set m/sec or a percentage of current speed). Flow proceeds back to 310, where the controller 50 continues to monitor battery voltage until the battery voltage is at a suitable level. Further speed reductions at 312 may be employed in a stepwise manner until the battery voltage is below the threshold.

If there is no battery deficiency at 310, flow proceeds to 314 where controller 50 determines if car load is available. If so, flow proceeds to 316 where controller 50 controls car speed in response to direction of car travel and car load, as shown in FIG. 6 and FIG. 7. As noted above, the car speed control using direct motor current in field weakening mode may also be used in conjunction with adjusting car speed in response to car load, as represented in FIG. 8

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as being limited by the foregoing description, but is only limited by the scope of the appended claims.

What is claimed is:

1. An elevator system comprising:

a battery;

a machine having a motor for imparting motion to an elevator car;

an inverter for converting DC power from the battery to AC power for the machine in motoring mode and converting AC power from the machine to DC power for the battery in regenerative mode; and a controller to control the inverter, the controller implementing at least one of:

detecting an overload at the battery in motoring mode and reducing car speed in response to the overload;

detecting an overcharge at the battery in regenerative mode and reducing car speed in response to the overcharge;

detecting motor direct current in a motor field weakening mode and reducing car speed in response to the motor direct current; and detecting car load and adjusting car speed in response to car load and car direction of travel.

2. An elevator system comprising:

a battery;

a machine having a motor for imparting motion to an elevator car;

an inverter for converting DC power from the battery to AC power for the machine in motoring mode and converting AC power from the machine to DC power for the battery in regenerative mode; and a controller to control the inverter, the controller implementing at least one of:

detecting an overload at the battery in motoring mode and reducing car speed in response to the overload;

detecting an overcharge at the battery in regenerative mode and reducing car speed in response to the overcharge;

detecting motor direct current in a motor field weakening mode and reducing car speed in response to the motor direct current; and detecting car load and adjusting car speed in response to car load;

wherein:

detecting the overload at the battery in motoring mode and reducing car speed in response to the overload includes:

detecting a voltage at the battery and reducing car speed if the voltage at the battery is below a threshold.

3. An elevator system comprising:

a battery;

a machine having a motor for imparting motion to an elevator car;

an inverter for converting DC power from the battery to AC power for the machine in motoring mode and converting AC power from the machine to DC power for the battery in regenerative mode; and a controller to control the inverter, the controller implementing at least one of:

detecting an overload at the battery in motoring mode and reducing car speed in response to the overload;

detecting an overcharge at the battery in regenerative mode and reducing car speed in response to the overcharge;

detecting motor direct current in a motor field weakening mode and reducing car speed in response to the motor direct current; and detecting car load and adjusting car speed in response to car load;

wherein:

detecting the overload at the battery in motoring mode and reducing car speed in response to the overload includes:

detecting a voltage at the battery and controlling car speed in response to a function relating battery voltage and car speed.

4. An elevator system comprising:

a battery;

a machine having a motor for imparting motion to an elevator car;

an inverter for converting DC power from the battery to AC power for the machine in motoring mode and converting AC power from the machine to DC power for the battery in regenerative mode; and a controller to control the inverter, the controller implementing at least one of:

detecting an overload at the battery in motoring mode and reducing car speed in response to the overload;

detecting an overcharge at the battery in regenerative mode and reducing car speed in response to the overcharge;

detecting motor direct current in a motor field weakening mode and reducing car speed in response to the motor direct current; and detecting car load and adjusting car speed in response to car load;

wherein:

detecting the overcharge at the battery in regenerative mode and reducing car speed in response to the overcharge includes:

detecting a voltage at the battery and reducing car speed if the voltage at the battery exceeds a threshold.

5. An elevator system comprising:

a battery;

a machine having a motor for imparting motion to an elevator car;

an inverter for converting DC power from the battery to AC power for the machine in motoring mode and converting AC power from the machine to DC power for the battery in regenerative mode; and a controller to control the inverter, the controller implementing at least one of:

detecting an overload at the battery in motoring mode and reducing car speed in response to the overload;

detecting an overcharge at the battery in regenerative mode and reducing car speed in response to the overcharge;

detecting motor direct current in a motor field weakening mode and reducing car speed in response to the motor direct current; and detecting car load and adjusting car speed in response to car load;

wherein:

detecting the overcharge at the battery in regenerative mode and reducing car speed in response to the overcharge includes:

detecting a voltage at the battery and controlling car speed in response to a function relating battery voltage and car speed.

6. The elevator system of claim 1, further comprising:

a dynamic braking resistor coupled to the converter;

wherein detecting the overcharge at the battery in regenerative mode includes:

the controller directing current from the converter to the dynamic braking resistor to reduce battery voltage prior to reducing car speed.

7. The elevator system of claim 1, wherein:

detecting motor direct current in motor field weakening mode and reducing car speed in response to the motor direct current includes:

detecting motor direct current and reducing car speed if motor direct current exceeds a threshold.

8. The elevator system of claim 1, wherein:

detecting motor direct current in motor field weakening mode and reducing car speed in response to the motor direct current includes:

detecting motor direct current and controlling car speed in response to a function relating motor direct current and car speed.

9. The elevator system of claim 1, wherein:

detecting car load and adjusting car speed in response to car load includes:

determining that the car is traveling up;

setting the car speed at an upper speed value;

reducing the car speed with increasing car load.

10. The elevator system of claim 9, wherein:

reducing the car speed with increasing car load includes comparing the car load to a load threshold and reducing the car speed upon the car load exceeding the load threshold.

11. The elevator system of claim 9, wherein:

reducing the car speed with increasing car load includes controlling car speed in response to a function relating car speed and car load.

12. The elevator system of claim 1, wherein:

detecting car load and adjusting car speed in response to car load includes:

determining that the car is traveling down;

setting the car speed at a lower speed value;

increasing the car speed with increasing car load.

13. The elevator system of claim 12, wherein:

increasing the car speed with increasing car load includes comparing the car load to a load threshold and increasing the car speed upon the car load exceeding the load threshold.

14. The elevator system of claim 12, wherein:

increasing the car speed with increasing car load includes controlling car speed in response to a function relating car speed and car load.

15. An elevator system comprising:

a battery;

a machine having a motor for imparting motion to an elevator car;

an inverter for converting DC power from the battery to AC power for the machine in motoring mode and converting AC power from the machine to DC power for the battery in regenerative mode; and a controller to control the inverter, the controller implementing at least one of:

detecting an overload at the battery in motoring mode and reducing car speed in response to the overload;

detecting an overcharge at the battery in regenerative mode and reducing car speed in response to the overcharge;

detecting motor direct current in a motor field weakening mode and reducing car speed in response to the motor direct current; and detecting car load and adjusting car speed in response to car load;

wherein:

the controller implements at least two of:

detecting an overload at the battery in motoring mode and reducing car speed in response to the overload;

detecting an overcharge at the battery in regenerative mode and reducing car speed in response to the overcharge; and detecting motor direct current in a motor field weakening mode and reducing car speed in response to the motor direct current.

16. An elevator system comprising:

a battery;

a machine having a motor for imparting motion to an elevator car;

an inverter for converting DC power from the battery to AC power for the machine in motoring mode and converting AC power from the machine to DC power for the battery in regenerative mode; and a controller to control the inverter, the controller implementing at least one of:

detecting an overload at the battery in motoring mode and reducing car speed in response to the overload;

detecting an overcharge at the battery in regenerative mode and reducing car speed in response to the overcharge;

detecting motor direct current in a motor field weakening mode and reducing car speed in response to the motor direct current; and detecting car load and adjusting car speed in response to car load;

wherein:

the controller implements each of:

detecting an overload at the battery in motoring mode and reducing car speed in response to the overload;

detecting an overcharge at the battery in regenerative mode and reducing car speed in response to the overcharge; and detecting motor direct current in a motor field weakening mode and reducing car speed in response to the motor direct current.

17. The elevator system of claim 1, wherein:

detecting the car load includes deriving the car load in response to a velocity control output.

* * * * *